US006000669A

United States Patent [19]

Seward et al.

[11] Patent Number: 6,000,669

[45] Date of Patent: Dec. 14, 1999

[54] LADDER TOOL HOLSTER

[76] Inventors: Eric Seward, 1528 Walnut #4, Berkeley, Calif. 94709; Mark E. Goshay, 116 Bishop Ave., Point Richmond, Calif. 94801

[21] Appl. No.: 08/961,702

[22] Filed: Oct. 31, 1997

[51] Int. Cl.[6] ..... E06C 7/14; E04G 3/00

[52] U.S. Cl. ..... 248/210; 248/291.1

[58] Field of Search ..... 248/146, 210, 248/218.4, 238, 309.1, 314, 291.1; 206/349, 305, 320; 182/129

[56] References Cited

U.S. PATENT DOCUMENTS

| | | | |
|---|---|---|---|
| 768,364 | 8/1904 | Hines . | |
| 2,911,133 | 11/1959 | Ruggieri . | |
| 4,703,833 | 11/1987 | Bachman . | |
| 4,828,209 | 5/1989 | Niemi | 248/221.1 |
| 4,964,601 | 10/1990 | Dishman . | |
| 5,072,868 | 12/1991 | Dickie et al. . | |
| 5,137,156 | 8/1992 | Riczinger et al. | 211/13 |
| 5,143,343 | 9/1992 | Katz | 248/551 |
| 5,201,445 | 4/1993 | Axelman | 224/197 |
| 5,333,823 | 8/1994 | Joseph | 248/146 |
| 5,370,263 | 12/1994 | Brown | 220/751 |
| 5,613,574 | 3/1997 | Melanson | 182/129 |
| 5,673,830 | 10/1997 | Matthews | 224/268 |
| 5,740,883 | 4/1998 | Trank | 182/129 |
| 5,816,548 | 10/1998 | Blossom, III | 248/206.5 |

*Primary Examiner*—Leslie A. Braun
*Assistant Examiner*—Dave Heisey

[57] ABSTRACT

A tool holder for pneumatic and electric power tools to be used when working on step ladders, extension ladders, scaffolding and other precarious elevated working environments where space for maneuvering and storing tools and materials is diminished. The tool receptacle (2) of the tool holder being especially designed to allow the storage of a wide variety of nail guns in a posture with the safety tip extended and the handle conveniently facing up towards the user facilitating the insertion, removal and operation of the tool being stored. The pivoting mounting assembly enables the holder to mount to support members that are at any angle in a vertical plane. The fastening straps with adjustable, quick release buckles enable the tool holder to be quickly and securely fastened to support members that are a wide variety of shapes and sizes. The storage pockets (24) on the front wall (8) of the holder are large enough to carry full size nail clips or a pair of safety glasses. The offset cams (26) facilitate the operation of the tool, by fastening only the amount of hose or cord needed the overall weight of the tool assembly and the chance of snags are decreased.

16 Claims, 4 Drawing Sheets

LADDER TOOL HOLSTER

BACKGROUND—FIELD OF INVENTION

This invention relates to tool holders, specifically to holders which are used for holding pneumatic and electric hand tools when working on ladders, scaffolding and other precarious elevated working environments.

BACKGROUND—DESCRIPTION OF PRIOR ART

Construction sites are full of hazards. Working off of ladders, scaffoldings, roofs and other elevated surfaces can increase the chance of accidents as the space for maneuvering and storing tools and materials is diminished. The common use of pneumatic and electric power tools in these conditions expedites the work process but also creates a new variety of problems. Nail guns can be particularly dangerous because conventionally the safety is located at the firing tip, directly above the nail exit path. When the operator's hand is on the trigger, every time the safety tip is depressed a nail is fired into whatever the tip touches or whatever happens to touch the tip. When the safety tip is extended the gun will not fire. Nail guns are precision instruments typically manufactured out of metal, they usually weigh several pounds and cost several hundred dollars. A falling nail gun poses many threats, for example: injury to other workers, damage to finished surfaces and materials, partial or total destruction of the tool. In the past tool holders have typically been comprised of a container or receptacle with varying means for being secured or attached to varied supports, i.e. ladders, scaffolding and workers belts. In most cases the containers are generally rectangular five sided forms having a front wall, a back wall, two opposing side walls and a bottom. A review of the prior art will clearly show the disadvantages of existing tool holders and will demonstrate the necessity and utility of the present invention.

BACKGROUND ART

U.S. Pat. No. 786,364 to Hines (1904) discloses a painter's appliance for holding paint cans, paint brushes, and other tools or supplies while working from a ladder. The means for attaching this holder to a ladder comprises a metal hook attached to the holders handle, the outward end of this hook being sharpened to a fine point. The holder hangs from the ladder by placing this hook over the rung of a ladder or by simply forcing the pointed end of the hook into the wooden rail. The pointed end of this hook can snag or puncture clothing or skin, while the pivoting nature of the open ended hook allows the holder to be accidentally tipped possibly spilling its contents or even completely dislodging the holder. Because of the centralized location of the partition/handle the holder is not well suited to carrying a single, relatively heavy tool while maintaining a level attitude. This holder does not induce a particular storage posture that facilitates the insertion and removal of power tools. When considering the possibility for cords or hoses (that powers electrical or pneumatic tools) to be accidentally snagged or pulled, the increased chance of dangerously tipping or dislodging this holder make it a poorly suited if not dangerous design for holding power tools.

U.S. Pat. No. 2,911,133 to Ruggierri (1957), U.S. Pat. No. 4,703,833 to Bachman (1987), U.S. Pat. No. 4,964,601 to Dishman (1990) and U.S. Pat. No. 5,072,868 to Dickie et al. (1991) disclose tool holders comprised of five sided substantially rectangular receptacles with means for attachment to a ladder for holding painting and carpentry hand tools.

None of these holders is specifically designed to store a wide range of nail guns in a posture with the safety tip extended, and that also facilitates the insertion, removal and operation of relatively large pneumatic and electric power tools. Additionally, the bottom of these receptacles limits the containment of tools with long blades or bits that are substantially longer than the confines of the receptacle and allows only partial insertion into the holder. If such tools are inserted blade or bit first the heavy main body of the tool is precariously close to or above the top of the holder allowing it to be easily dislodged. If the tool is inserted handle first the blade or bit would protrude dangerously up and out of the holder requiring special attention during insertion, removal and while working.

Ruggierri(U.S. Pat. No. 2,911,133) discloses a means of attachment that is limited to supports of a specific predetermined dimension, in this particular case, the relatively thin high aspect profile of the top platform of a wooden step ladder. This particular holder could not be attached to thicker lower aspect support members such as the top platform, rungs and rails of fiberglass or aluminum step and extension ladders or the tubes that comprise scaffolding supports and safety rails without having a different strap configuration for each different support member.

Bachman(U.S. Pat. No. 4,703,833) discloses a means of attachment limited to step ladders having incorporated shelves. In order for this holder to be used with step ladders without shelves, extension ladders or scaffolding, an entirely redesigned means of attachment would be required.

Dishman(U.S. Pat. No. 4,964,601) discloses "a bungee cord having hooks at both ends wrapped around the outside walls of the top of the container and hooked around the ladder or other structure it is desired to hold the container against". This configuration does not work well with horizontal or nearly horizontal support members as the contents would be prone to spill from the holder. Although bungees are highly flexible, when they are used with items smaller than intended they fit loosely, do not hold well and are easily unhooked. When used with items larger than intended they are difficult to fasten and unfasten and the end hooks become dangerous projectiles when accidentally released.

Dickie et al.(U.S. Pat. No. 5,072,868) discloses a hinged gripper that allows attachment to a painter's belt, a ladder strut or the lip of a paint can. This design does not allow attachment to a wide range of dimensions without requiring a proportionately wide range of holder sizes. Additionally, the hinged gripper does not afford a secure form of attachment in most modes. When the gripper is folded down to form an aperture for accepting a support member, in this particular case a belt, the resistance of the wearer against the side of the gripper is essential in combination with the force of gravity on the receptacle to keep the aperture from opening and the holder from being dislodged. When the bottom cut-outs are gripping an external edge, such as a ladder strut or the curved lip of a paint can, attachment relies mainly on gravity and the holder can be easily dislodged.

As evidenced by a review of the prior art all tool holders heretofore known suffer from a number of disadvantages:

(a) The shape of these holders does not promote a storage posture of pneumatic nail guns with the safety tip extended, which increases the chances of misfire during insertion and removal.

(b) The shape of these holders does not promote a posture that facilitates the insertion, removal and operation of pneumatic and electric power tools.

(c) The bottom of these holders does not allow safe, secure containment of tools that are substantially longer than the confines of the container.

(d) The means for attaching these holders are limited to members of similar shape and size or similar attitudes (relatively close to horizontal or vertical).

(e) The means for attaching these holders are either quick or secure but not both, quick and secure.

OBJECTS AND ADVANTAGES

Accordingly several objects and advantages of the present invention are:

(a) to provide a holder that holds pneumatic tools in a storage posture with the safety tip extended and protected from accidental contact reducing the chances of misfire during insertion and removal;

(b) to provide a holder that holds pneumatic and electric power tools in a posture that facilitates their insertion, removal and operation;

(c) to provide a holder that allows the safe, secure containment of tools that are substantially longer than the confines of the holder;

(d) to provide a holder that attaches to members of a wide range of shapes, sizes, and angles;

(e) to provide a holder that attaches quickly and securely to support members;

(f) to provide a holder that decreases fatigue and facilitates the operation of the tool stored in the holder.

(g) to provide a holder that securely holds a wide range of shapes and sizes of pneumatic and electric power toots. The tool receptacle of the holder can be made of non-conductive molded plastic, reducing the danger of electrical shock, increasing the ability to absorb shock when dropped or knocked about and enabling manufacture in a variety of high visibility safety colors. By fastening hoses or cords into the offset cams on the holder the user can operate the power tool lifting only the amount of hose or cord needed, which can significantly decrease the weight of the whole tool assembly. Still further objects and advantages will become apparent from a consideration of the ensuing description and drawings.

DRAWING FIGURES

In the drawings, closely related figures have the same number but different alphabetic suffixes.

FIG. 2D is a front elevation view of a tool receptacle embodying the invention.

FIG. 3 is a front elevation of an alternative embodiment of the tool receptacle of the present invention.

FIG. 4 is a front elevation of an alternative embodiment of the tool receptacle of the present invention.

REFERENCE NUMERALS IN DRAWINGS

Figure 1A:
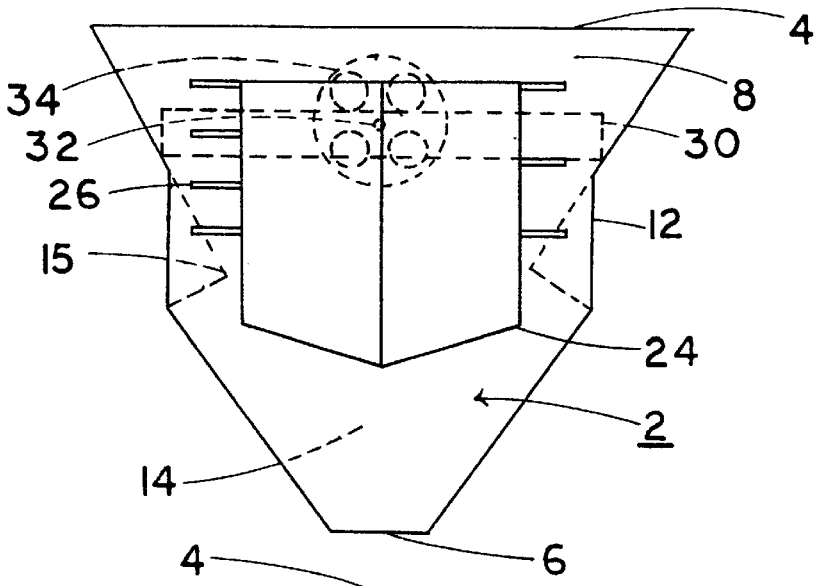
FIG. 1A is a front elevation view of a holder embodying the invention.

2 tool receptacle
4 top opening
6 bottom opening
8 front wall
10 back wall
12 side walls
14 safety chamber
15 internal clips
16 full length tab
18 strap slots
24 storage pockets
26 offset cams
30 pivoting angle bracket
32 threaded bolt/stud
34 oversize nut/washer
36 straps
40 step ladder
50 nail gun

DETAILED DESCRIPTION

Figure 1B:
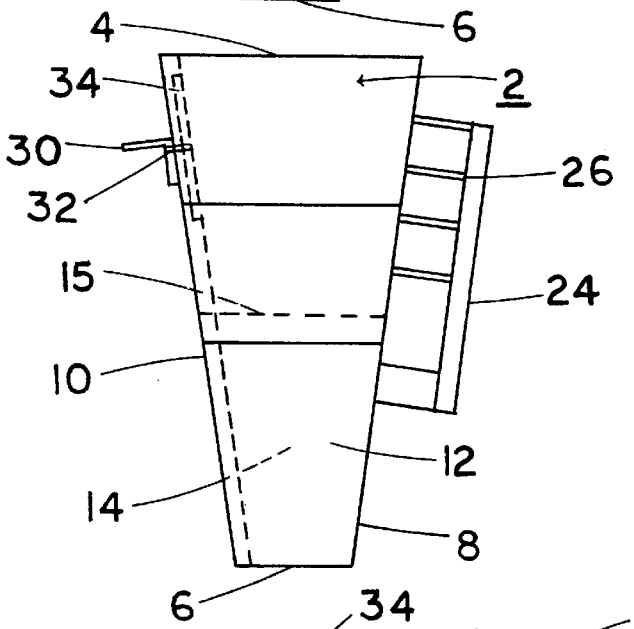
FIG. 1B is a left side elevation view of FIG. 1A.
Figure 1C:
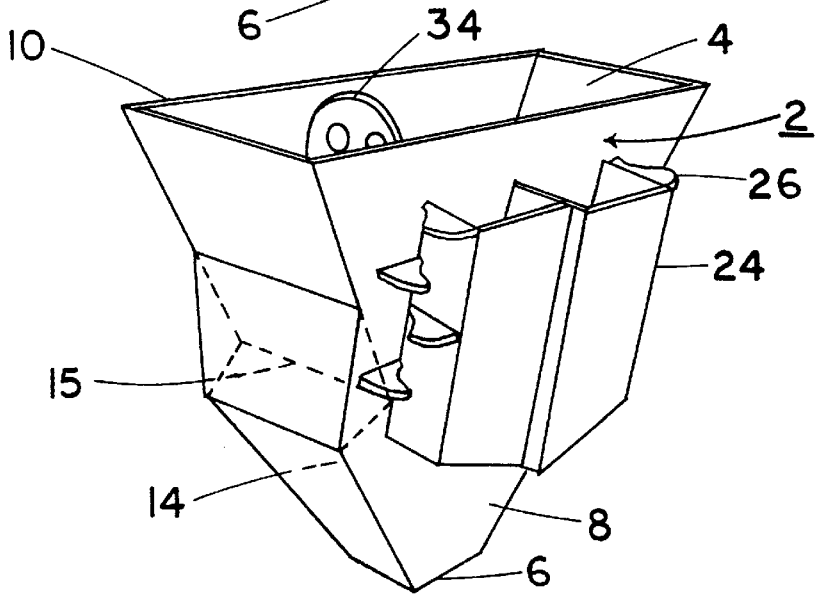
FIG. 1C is a left side perspective view of FIG. 1A.
Figure 1D:
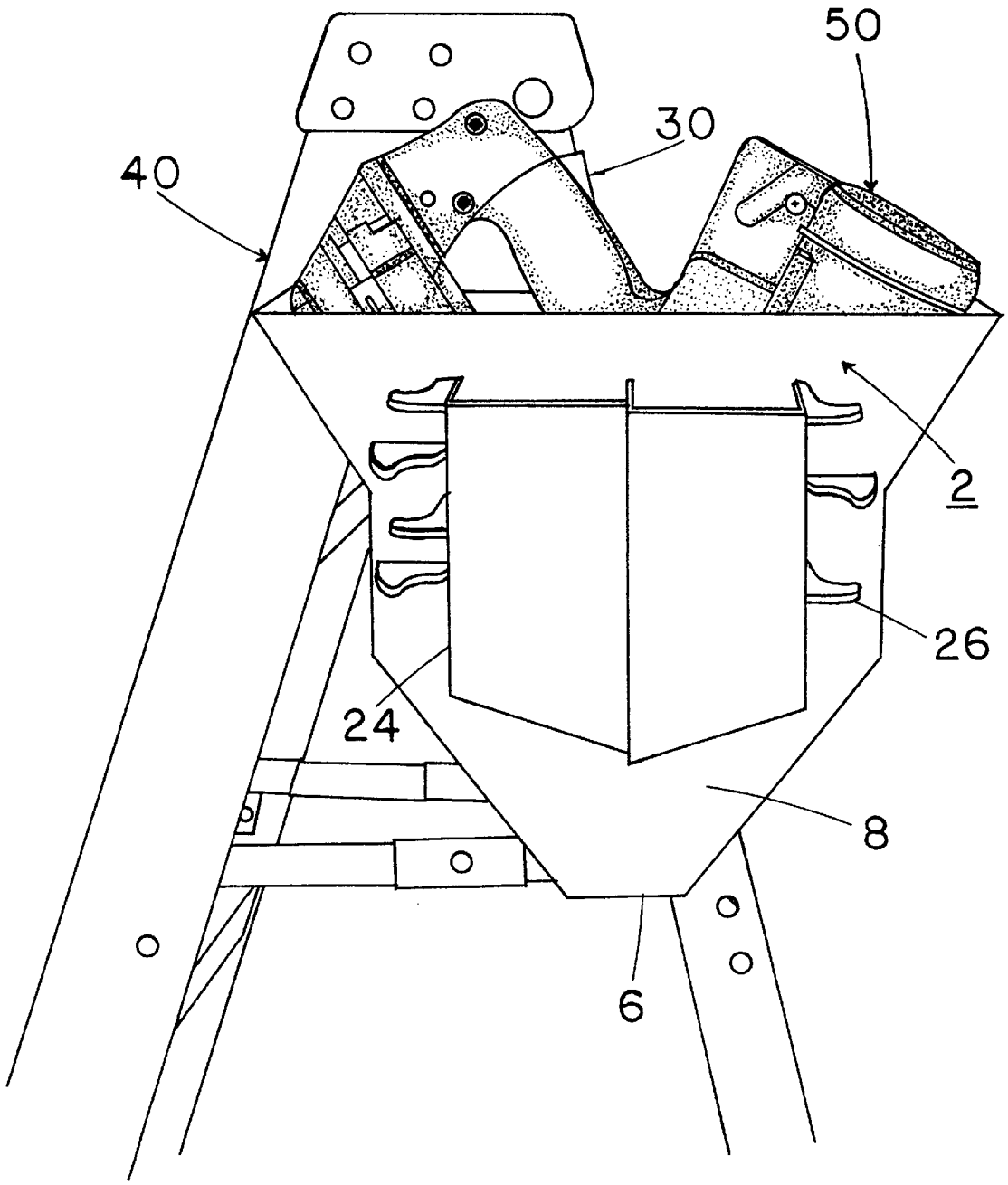
FIG. 1D is a front elevation view of FIG. 1A shown mounted to step ladder and holding a nail gun.
Figure 1E:
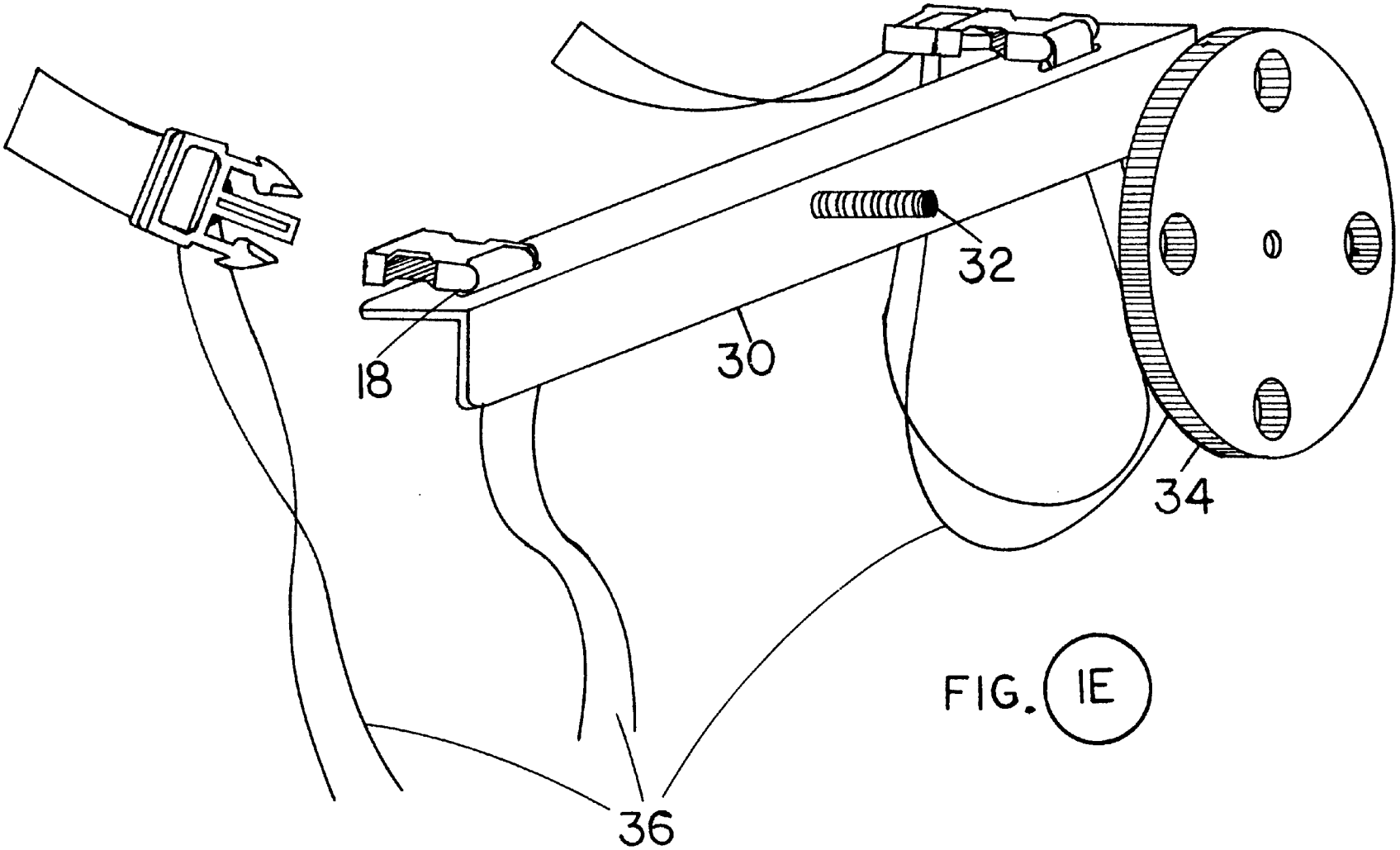
FIG. 1E is a perspective view of the pivoting mounting assembly of FIG. 1A.

A typical embodiment of the tool holder of the present invention is illustrated in FIG. 1A (Front view), FIG. 1B (Side view), FIG. 1C (Perspective view), Fig. 1D (Operational view), and FIG. 1E (perspective view, pivoting mounting assembly). The holder has a four sided, tapered tool receptacle 2, with a relatively large top opening 4, and a smaller bottom opening 6. In preferred embodiment the tool receptacle is made of non-conductive, resilient, semi-flexible injection molded plastic, such as polyethylene. However the tool receptacle can be manufactured from a wide range of materials, such as acrylic resin, polycarbonate, epoxy and polyurethane impregnated composite fabrics, welded or molded metal alloys, plywood, sheet plastics, etc. The tool receptacle 2 has a back wall 10 and a front wall 8. The angled plane of the side walls is interrupted by a skewed section. This skewed section forms an expanded interior space or "safety chamber" 14 which allows the stowage of a pneumatic nail gun with the safety tip extended. The shape of the safety chamber 14 can be internally modified by a pair of internal angle clips 15 that are desirable to allow stowage of a variety of nail guns while maintaining a receptacle shape that is easily manufactured. The holder in FIGS. 1A to 1E has a pivoting mounting assembly. The pivoting mounting assembly comprises a pivoting angle bracket 30 which is attached to the outside of the back wall 10 by a threaded stud 32. The threaded stud 32 passes through the back wall 10 and threads into an oversize nut/washer 34 which is recessed flush into the inside of the back wall 10. The pivoting angle bracket 30 has a strap slot 18 at each end. A conventional strap with a quick release buckle is lead through each strap slot 18 and securely fastens the holder to a desired support member. Joined to the outside of the front wall 8 are a pair of adjacent storage pockets 24 both capable of holding full size nail clips and one being slightly larger to accommodate safety eye wear. In each corner formed between the sides of the pockets 24 and the front wall 8 are a series of offset cams 26 which retain cords or hoses lead between them.

Figure 2A:
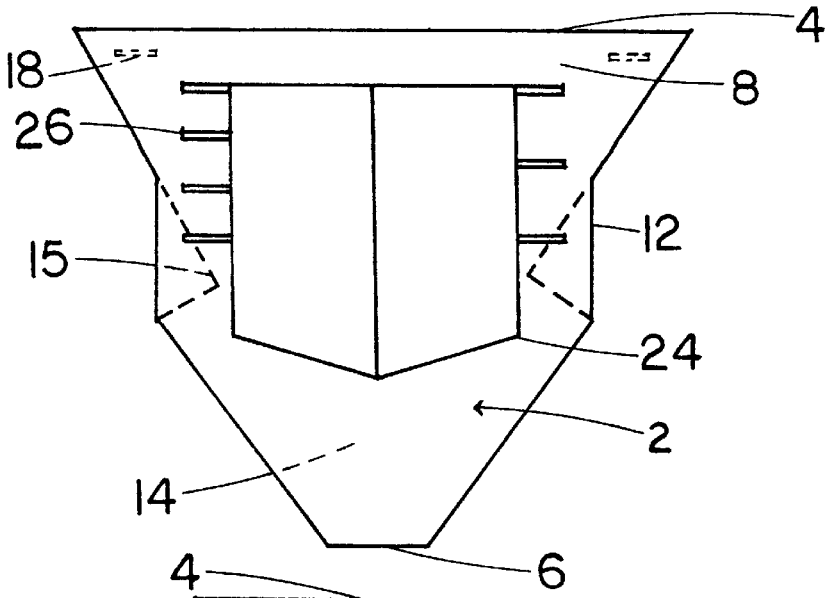
FIG. 2A is a front elevation view of a holder embodying the invention with full length tab.
Figure 2B:
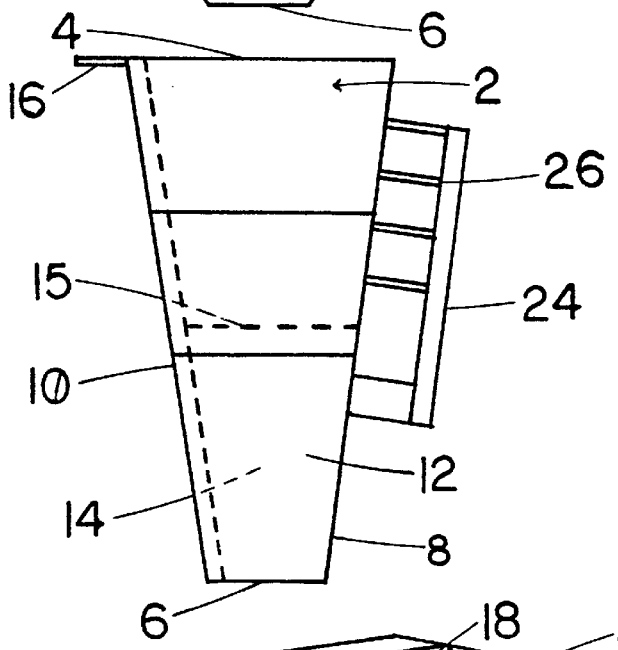
FIG. 2B is a left side elevation view of FIG. 2A.
Figure 2C:
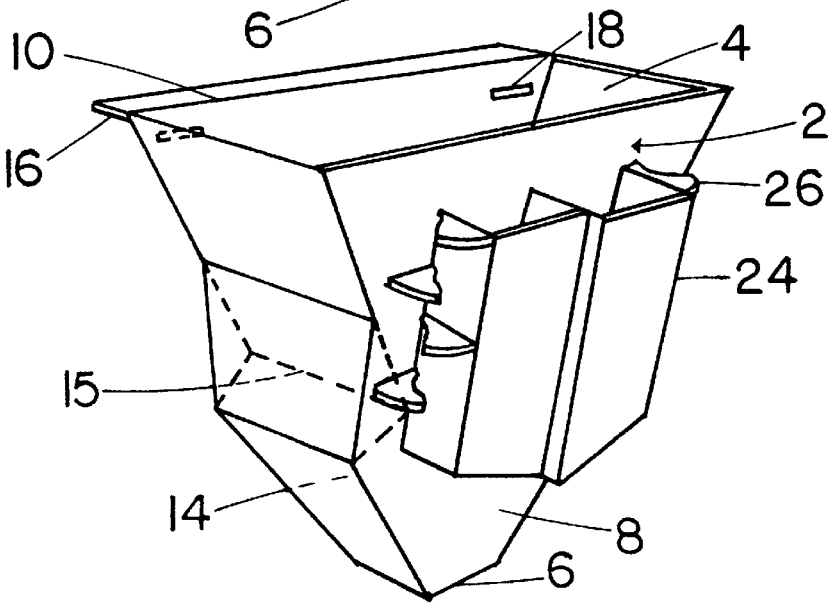
FIG. 2C is a left side perspective view of FIG. 2A.

Additional embodiments of the present invention are illustrated in FIGS. 2A–2C. The holder shown in FIGS. 2A–2C is the same as the holder shown in FIGS. 1A–1E with the exception of the mounting assembly.

The holder shown in FIG. 2A (front view), FIG. 2B (side view), FIG. 2C (perspective view) has a full length tab 16 joined to the outside upper edge of the back wall 10 in place of the pivoting mounting assembly. The full-length tab 16 enables the holder to hang from ladders, scaffolding and a wide variety of other relatively horizontal support members. A pair of strap slots 18 are located on the back wall 10 below the full length tab 16. A conventional strap with a quick release buckle (not shown), is lead through each strap slot 18 and securely fasten the holder to a desired support member.

From the description above, a number of advantages of our tool holders become evident:

(a) A tool holder that safely and securely stows a variety of nail guns in a posture with the safety tip extended, and protected from accidental contact, when working off of step ladders, extension ladders, scaffolding, and other precarious elevated work environments where space for storing and operating tools is diminished.

(b) A tool holder that saves time and money by storing tools in a posture with the handle facing towards the user. This posture facilitates true single handed installation and removal because the user does not need to change his grip on the tool while removing, operating, or returning the tool to the holder.

(c) The downwardly tapered shape of the holder leading to the open bottom aperture allows a wide variety of pistol grip and D-handle grip tools with long bits or blades to nestle snugly down into the receptacle. Because blades or bits that protrude down through the bottom aperture hang within the profile of the ladder they are less likely to be snagged than when in other storage postures.

(d) The pivoting mounting assembly allows the holder to be mounted to support members of any angle in a vertical plane, for example: the vertical tubes that constitute scaffolding support frames, the tilted side rails of step and extension ladders, or the horizontal top platform of step ladders. The adjustable quick release fastening straps quickly and securely fasten the holder to these aforementioned support members and a variety of others of different shapes and sizes.

(e) The offset cams formed between the sides of the storage pockets and the front wall of the receptacle facilitate the operation of tools being used with the holder. By fastening an air hose or electrical cord into the offset cams with enough slack to maneuver the tool, the weight of the overall tool assembly being manipulated is decreased which in turn makes the overall work process more comfortable and less tiring. Because the proper amount of slack needed to operate the tool is controlled at the holder, the whole assembly (tool, tool holder, and ladder) can be moved about without wasting time by climbing up the ladder only to realize there is no longer sufficient slack to reach the work surface and then having to climb back down the ladder to arrange for proper slack in the air hose or cord before completing the task at hand.

OPERATION

The mounting procedure of the tool holder with the pivoting mounting assembly FIGS. 1A–1E is a quick and simple process. First the oversize nut/washer 34 is loosened slightly to allow the pivoting angle bracket 30 to pivot relative to the tool receptacle 2. Then the inside of the pivoting angle bracket 30 is laid against the desired support member and the fastening straps are placed around the support member, then by engaging the quick release buckles, and cinching the straps tight the holder assembly is secured to the support member. The tool receptacle 2 is then pivoted so the top edges of the container are horizontal and is then locked into position by tightening the oversize nut 34. When mounted to nearly vertical support members one of the fastening straps can pass over the top of any horizontal support that intersects the main vertical support member to help the holder assembly resist sliding downward. The offset cams 26 are employed by first determining the amount of slack needed to work freely and then slightly bending the appropriate section of air hose or cord while pushing it into the cams one at a time. Installation and removal of the tool from the ladder holster is most closely related to the act of using a pistol with a holster. The tool is put into the holder tip first and when released settles into a posture with the handle facing up toward the user and the safety tip of the gun hanging down, extended, inside the open area of the safety chamber 14. Because the handle is facing the user the gun is easily removed from the holder with the same grip as that needed to operate the tool.

The mounting procedure of the tool holder with the full length tab 16, FIGS. 2A–2C, is very similar to the mounting procedure of the holder in FIGS. 1A–1E. The full length tab 16 limits mounting options of the holder to support members that are very close to horizontal. The inside of the corner formed between the full length tab 16 and the outside face of the back wall 10 is laid against the desired support member. The fastening straps are placed around the support member, then by engaging the quick release buckles, and cinching the straps tight, the holder assembly is secured to the support member. Because the tool receptacle 2 of this holder and the holder shown in FIGS. 1A–1E are identical, with the exception of the mounting assemblies, use of the offset cams 26 and installation and removal of tools from the holder is also identical.

SUMMARY, RAMIFICATIONS, AND SCOPE

Accordingly the tool holder of this invention can be used to quickly, easily and safely stow pneumatic and electrical power tools when working on ladders, scaffolding and other precarious elevated work environments where space to store and operate tools is diminished. Furthermore the tool holder has the additional advantages in that

- it stores nail guns in a posture with the safety tip extended which reduces the chance of misfire during insertion and removal;
- it stores pistol grip and D-handle grip pneumatic and electric tools in a storage posture with the handle facing up towards the user enabling single handed operation by facilitating the removal and installation of the tool using the same grip needed for operation;
- it safely stores tools with long bits or blades;
- it can be mounted to support members of any angle in a vertical plane;
- it reduces fatigue of the user by decreasing the overall weight of the tool when using the offset cams.

Although the description above contains many specificities, these should not be construed as limiting the scope of the invention but as merely providing illustrations of some of the presently preferred embodiments of this invention. For example, the holder can have a more rounded, more organic shape by easing the corners of the tool receptacle; the quick release buckles could be replaced by other types of strap fasteners, such as heavy duty overall/garter type buckles, or hook and loop fasteners, etc.; the pockets and/or the offset cams could be removed; the full size nut/washer could be replaced by a conventional screw on knob handle; the holder could be incorporated with the top platform of a ladder forming a one piece unit or have an attached hood that slips over the top platform of a ladder; the holder assembly could be bolted directly to a support member in place of the quick release mounting bracket configurations, etc.

We claim:

1. A pivoting tool holding apparatus comprising a pivoting mounting assembly and a tool holder for use with stepladders extension ladder and scaffoldings, said pivoting assembly comprising a threaded stud adapted to pass through a support member and said tool holder and into a threaded fastening device, said tool holder having a tool receptacle, said tool receptacle having a front wall, a back wall and a side wall joining the vertical extremities of said front and said back wall, the inward declivity of said front wall, said back wall and said side walls making said tool receptacle substantially pyramidal, the vertex of which being truncated at a predetermined point, said side walls having a skewed section forming a narrowed constriction between the top and bottom of said tool receptacle, resulting in a safety chamber formed below said narrowed constriction, said safety chamber being wider than said narrowed constriction above, said tool receptacle being symmetrical about both the y-axis which is parallel to the top of the receptacle running from side to side and the z-axis which is parallel to the top of the receptacle running fore and aft, whereby the holder is adapted to pivotably mount to support members at any angle from horizontal to vertical, within a vertical plane, whereby said safety chamber allows a wide variety of nail guns of varying sizes to be stored with the safety tip disengaged and protected from accidental engagement, whereby the apparatus allows reversible storage of tools for the interchangeable, ambidextrous access and usage of tools, when mounted to the top platform of stepladders and other substantially horizontal support members, leaving the top platform of step ladders free for the staging of materials to be installed, whereby the apparatus mounts to support members such as legs or side rails on either side of step and extension ladders while maintaining equal access to stored tools.

2. The pivoting mounting assembly of claim 1 wherein said threaded stud passes through a mounting bracket, then passes through said tool holder and into said threaded fastening device.

3. The holder of claim 2 wherein said mounting bracket has a means of attaching adjustably and releasably to support members, said means of attaching comprising a plurality of adjustable, quick release straps being adapted to attach to said mounting bracket, whereby the holder is adapted to pivotably mount to support members of a wide variety of shapes, sizes and orientations.

4. The apparatus of claim having a pocket assembly being adapted to attach to the outside of said front wall of said tool receptacle, said front wall forming one side of said pocket assembly, whereby nail gun nail strips and safety glasses may be stored.

5. The apparatus of claim 1 having a series of linearly disposed offset cams being adapted to attach to the outside face of said front wall, whereby air hoses and cords are adapted to be held in an adjustable quick release manner, allowing the overall scope and weight of the tool holding apparatus to be continually adjusted and optimized.

6. The apparatus of claim 1 having an internal clip of predetermined dimensions being adapted to attach to the inside surface of the walls of said tool receptacle for defining the internal shape of said tool receptacle, whereby the internal shape is maintained when the overall exterior shape is changed for aesthetic or manufacturing reasons.

7. A pivoting tool holding apparatus for holding nail guns and a variety of electrical power tools when working from stepladders, extension ladder and scaffoldings, comprising:

a) a pivoting mounting assembly having a mounting bracket with a threaded stud inserted, said threaded stud passing through a tool receptacle and into a threaded fastening device, said mounting bracket having a plurality of adjustable, quick release straps being adapted to attach to said mounting bracket for mounting to support members, b) a tool receptacle having a front wall, a back wall and a side wall joining the vertical extremities of said front and said back wall, the inward declivity of said front wall, said back wall and said side walls making said tool receptacle substantially pyramidal, the vertex of which being truncated at a predetermined point, said side walls having a skewed section forming a narrowed constriction between the top and bottom of said tool receptacle, resulting in a safety chamber, said safety chamber being wider than the narrowed constriction above, said tool receptacle being symmetrical about both the y-axis which is parallel to the top of the receptacle running from side to side and the z-axis which is parallel to the top of the receptacle running fore and aft, whereby the apparatus is adapted to pivotably mount to support members of a wide variety of shapes, sizes and orientations, leaving the top platform of stepladders free for the staging of materials to be installed, whereby the apparatus stores a wide variety of nail guns of varying sizes with the safety tip disengaged and protected from accidental engagement, whereby the apparatus allows reversible storage of tools for ambidextrous access and usage of tools, without rearranging or readjusting the apparatus, when mounted to the top platform of a stepladder, whereby the apparatus allows bilateral mounting with equal access when mounted to the legs or side rails of step and extension ladders.

8. The apparatus of claim 7 having a pocket assembly being adapted to attach to the outside of said front wall of said tool receptacle, said front wall forming one side of said pocket assembly, whereby nail gun nail strips and safety glasses may be stored.

9. The apparatus of claim 7 having a means for holding air hoses and cords in an adjustable quick release manner, said means for holding comprising a series of linearly disposed offset cams being adapted to attach to the outside face of said front wall, whereby the overall scope and weight of the tool holding apparatus is continually adjusted and optimized.

10. The apparatus of claim 7 wherein said tool receptacle has a means for defining the internal shape of said tool receptacle, said means of defining being an internal clip of predetermined dimensions being adapted to attach to the inside surface of the walls of said tool receptacle, whereby the internal shape is maintained when the overall exterior shape is changed for aesthetic or manufacturing reasons.

11. A pivoting tool holding apparatus for holding nail guns and a variety of electrical power tools for mounting to stepladders, extension ladder and scaffolding environments, comprising:

a) a pivoting mounting assembly having a threaded stud disposed to pass through a support member, continue through a tool holder and into a threaded fastening device, b) said tool holder having a tool receptacle, said tool receptacle having a front wall, a back wall and a side wall joining the vertical extremities of said front and said back wall, the declivity of said front wall, said back wall and said side walls making said tool receptacle substantially pyramidal, so that nail guns which are substantially triangular in shape are adapted to settle securely into the receptacle, the vertex of the pyramidal receptacle is truncated at a predetermined point, so that long blades and bits are adapted to pass through the truncated bottom of the receptacle allowing the relatively heavy body of the tool to settle securely into the holder, said side walls having a skewed section forming a narrowed constriction between the top and bottom of said tool receptacle, resulting in a safety chamber, said safety chamber being wider than the narrowed constriction above, the narrowed constriction stops the downward settling of the tool while the safety chamber provides a space in which the safety tip of the nail gun is unengaged and protected from accidental contact, said tool receptacle being symmetrical about both the y-axis which is parallel to the top of the receptacle running from side to side and the z-axis which is parallel to the top of the receptacle running fore and aft, allowing reversible storage of tools for ambidextrous access and usage of tools as well as the bilateral positioning and mounting of the tool receptacle to the legs or side rails of step and extension ladders.

12. The apparatus of claim 11 wherein said threaded stud passes through a mounting bracket, then passes through said tool holder and into said threaded fastening device.

13. The apparatus of claim 12 wherein said mounting bracket has a plurality of adjustable, quick release straps adapted to attach to said mounting bracket, whereby the holder is adapted to pivotably mount to support members of a wide variety of shapes, sizes and orientations in a quickly adjustable and releasable manner.

14. The apparatus of claim 11 having a pocket assembly being adapted to attach to the outside of said front wall of said tool receptacle, said front wall forming one side of said pocket assembly, whereby nail gun nail strips and safety glasses may be stored.

15. The apparatus of claim 11 having a series of linearly disposed offset cams being adapted to attach to the outside face of said front wall, whereby air hoses and cords are adapted to be held in an adjustable quick release manner, allowing the overall scope and weight of the tool holding apparatus to be continually adjusted and optimized.

16. The apparatus of claim 11 having an internal clip of predetermined dimensions being adapted to attach to the inside surface of the walls of said tool receptacle for defining the internal shape of said tool receptacle, whereby the functional interior shape is maintained when the overall exterior shape is changed for aesthetic or manufacturing reasons.

* * * * *